US008452200B2

(12) United States Patent
Ogiso et al.

(10) Patent No.: US 8,452,200 B2
(45) Date of Patent: May 28, 2013

(54) IMAGE FORMING APPARATUS

(75) Inventors: Marika Ogiso, Nagoya (JP); Kensuke Miyahara, Hekinan (JP); Yoh Nishimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 13/045,852

(22) Filed: Mar. 11, 2011

(65) Prior Publication Data

US 2011/0255889 A1 Oct. 20, 2011

(30) Foreign Application Priority Data

Apr. 19, 2010 (JP) ..... 2010-095813

(51) Int. Cl.
*G03G 15/00* (2006.01)

(52) U.S. Cl.
USPC ..... 399/44; 399/228; 399/71

(58) Field of Classification Search
USPC ..... 399/44, 55, 71, 129, 223, 228, 343
See application file for complete search history.

(56) References Cited

U.S. PATENT DOCUMENTS

| | | | | |
|---|---|---|---|---|
| 7,274,889 | B2 * | 9/2007 | Furukawa | 399/71 |
| 7,792,464 | B2 * | 9/2010 | Okabe et al. | 399/228 |
| 2008/0317506 | A1 | 12/2008 | Furukawa | |
| 2010/0074646 | A1 | 3/2010 | Miyahara et al. | |

FOREIGN PATENT DOCUMENTS

| | | |
|---|---|---|
| JP | 06-075484 | 3/1994 |
| JP | 11-133696 | 5/1999 |
| JP | 2002-031967 | 1/2002 |
| JP | 2003-043890 | 2/2003 |
| JP | 2007-219090 | 8/2007 |
| JP | 2009-003377 | 1/2009 |
| JP | 2010-078848 | 4/2010 |

OTHER PUBLICATIONS

Notification of Decision to Grant issued in corresponding Japanese Patent Application No. 2010-095813 dated Sep. 25, 2012.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

An image forming apparatus includes: photosensitive members; an endless belt facing the photosensitive members; developing rollers respectively supplying, to the photosensitive members, developer of different colors which is charged to a first polarity; cleaning rollers adjacent to the photosensitive members; a separating mechanism separating the developing roller from the photosensitive member in a single color printing. If in a multi color printing, a control unit applies a cleaning bias whose polarity is a second polarity opposite to the first polarity and which holds a first electric potential to each cleaning roller. If in the single color printing, the control unit executes a bias reduction control in which a cleaning bias applied to the cleaning roller not used in the single color printing is given the second polarity and is made to hold a second electric potential whose absolute value is smaller than that of the first electric potential.

5 Claims, 8 Drawing Sheets

COLOR MODE

MONOCHROME MODE

IMAGE FORMING APPARATUS

This application is based upon and claims the benefit of priority of Japanese Patent Application No. 2010-095813 filed on Apr. 19, 2010, the contents of which are incorporated herein by reference in its entirety.

BACKGROUND

The disclosure relates to an image forming apparatus which can execute monochrome printing and color printing.

In an electrophotographic color image forming apparatus, a plurality of types of toner of predetermined colors are prepared, and photosensitive drums, developing rollers and transfer rollers are provided so as to correspond to those colors, whereby toner images based on the predetermined colors are placed on an intermediate transfer belt or a recording sheet (in this specification, a medium which receives a transferred image is used to refer to the intermediate transfer belt and the recording sheet altogether).

In the color image forming apparatus, monochrome printing is executed properly by using only toner for monochrome printing (normally, black toner). Therefore, as to the developing devices for the other colors, it is known that the photosensitive drums and the developing rollers are kept separated so as to restrain the deterioration of toner of the remaining colors.

On the other hand, toner on the surface of the photosensitive drum cannot be transferred in whole from the photosensitive drum to a medium for receiving a transferred image, and a slight amount of toner remains on the surface of the photosensitive drum. Therefore, the surface of the photosensitive drum needs to be cleaned to remove the remaining toner. As one of cleaning methods for removing toner remaining on a photosensitive drum, there is, for example, a method in which remaining toner is recovered by a developing roller so as to make it dispersed in toner accommodated in a developing device, and this type of cleaning method is referred to as a cleaner-less method.

Additionally, as such a remaining toner cleaning method, there is also a cleaning method in which a bias is applied to a cleaning roller which is in contact with a photosensitive drum to thereby recover remaining toner by the cleaning roller.

SUMMARY

However, in the event that the cleaner-less method is adopted in an image forming apparatus configured so that other developing rollers and photosensitive drums than those used for monochrome printing are separated from each other in monochrome printing, when toner placed on a medium during monochrome printing adheres to photosensitive drums disposed downstream of the photosensitive drum for monochrome printing (this phenomenon is referred to as "reverse transfer"), the toner is not recovered by developing rollers due to the separation of the photosensitive drums from the developing rollers. Therefore, the toner which is reversely transferred to the photosensitive drums is retransferred to the medium, whereby there may be caused a situation in which a ghost image is produced on the medium.

To solve this problem, it is considered that a cleaning roller is provided on photosensitive drums in addition to the cleaner-less method. According to this configuration, even in the event that toner for monochrome printing is reversely transferred to the photosensitive drums downstream of the photosensitive drum for monochrome printing when monochrome printing is executed, the reversely transferred toner can be recovered by the cleaning rollers which are in contact with the corresponding photosensitive drums.

However, under a high-temperature, high-humidity environment, there may be caused a situation in which toner whose polarity is changed is reversely transferred, and as this occurs, since a bias applied to the cleaning rollers is set to correspond to the original polarity of toner before change in polarity, there is caused a fear that toner whose polarity is changed cannot be recovered well by the cleaning rollers.

Then, an aspect of the disclosure is to restrain the generation of a ghost image even when toner (developer) whose polarity is changed is reversely transferred to photosensitive drums (photosensitive members).

The aspect of the disclosure provides an image forming apparatus comprising:

first and second photosensitive members which are arranged in a row, and are configured to form an electrostatic latent image thereon;

an endless belt having a belt surface which faces the first and second photosensitive members and configured to rotate so that the belt surface moves in a traveling direction from the first photosensitive member to the second photosensitive member;

first and second developing rollers configured to respectively supply, to the first and second photosensitive members, developer of different colors which is charged to a first polarity;

first and second cleaning rollers provided so as to be adjacent respectively to the first and second photosensitive members for recovering the developer adhering to the first and second photosensitive members;

a separating mechanism configured to separate the second developing roller from the second photosensitive member; and a control unit configured, if a single color printing is executed by the first developing roller, to control the separating mechanism so as to separate the second developing roller from the second photosensitive member, wherein if a multi color printing is executed, the control unit applies a cleaning bias whose polarity is a second polarity opposite to the first polarity and which holds a first electric potential to each of the first and second cleaning rollers, and wherein if the single color printing is executed, the control unit executes a bias reduction control in which a cleaning bias applied to the second cleaning roller is given the second polarity and is made to hold a second electric potential whose absolute value is smaller than that of the first electric potential.

BRIEF DESCRIPTION OF THE DRAWINGS

FIG. 8A is a drawing showing a state in which the toner is held by the cleaning roller and FIG. 8B is a drawing showing a state in which the toner on the cleaning roller is recovered by the cleaning roller.

DESCRIPTION OF EXEMPLARY EMBODIMENTS

Figure 1:
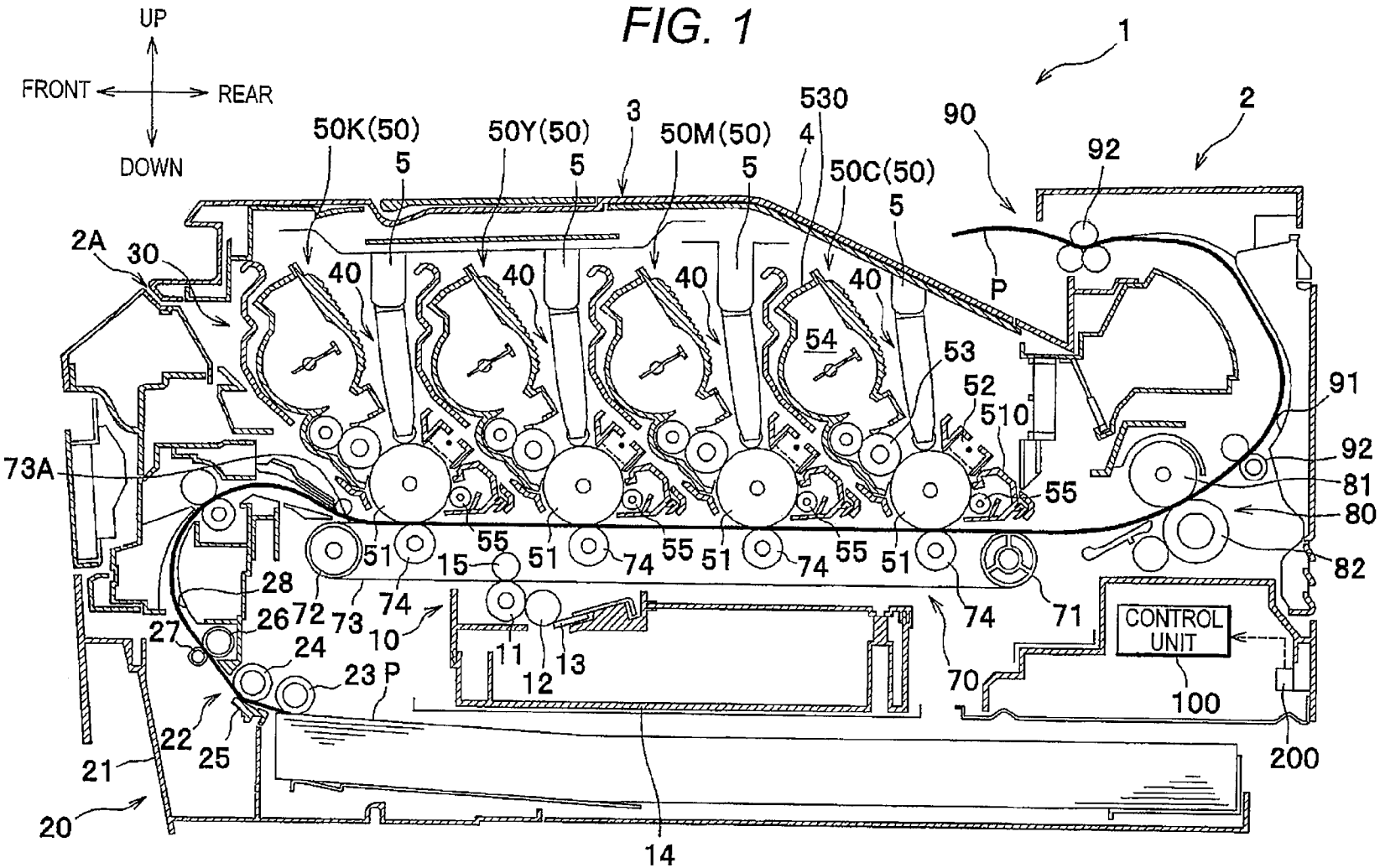
FIG. 1 is a side sectional view of a color printer which is an example of an image forming apparatus according to an exemplary embodiment.

Next, an exemplary embodiment will be described in detail while referring to the drawings as required. In the following description, directions will be described based on the position of a user of a color printer. Namely, in FIG. 1, with the user standing to face the sheet of paper on which a side sectional view of a color printer is drawn, a left-hand side of the figure is referred to as a "front side," a right-hand side as a "rear side," a farther side as a "left-hand side," and a nearer side as a "right-hand side" of the color printer. In addition, Upward and downward directions of the figure are referred to as "upward and downward directions" of the color printer.

<Overall Configuration of Color Printer>

As is shown in FIG. 1, a color printer 1 includes a feeder unit 20 for feeding a sheet P as an example of a recording sheet, an image forming unit 30 for forming an image on the sheet P fed, a sheet discharge part 90 for discharging the sheet P on which an image is formed and a control unit 100 within an apparatus main body 2.

An opening portion 2A is formed in an upper portion of the apparatus main body 2. The opening portion 2A is designed to be opened and closed by an upper cover 3 which is supported rotatably on the apparatus main body 2. An upper surface of the upper cover 3 is configured as a sheet discharging tray 4 where sheets P discharged from the apparatus main body 2 are accumulated. A plurality of LED mounting members 5 are provided on a lower surface of the upper cover 3, and LED units 40 are held on the LED mounting members 5.

The feeder unit 20 is provided at a lower portion within the apparatus main body 2 and includes mainly a sheet feeding tray 21 which is detachably installed in the apparatus main body 2 and a sheet feeding mechanism 22 for conveying a sheet P from the sheet feeding tray 21 to the image forming unit 30. The sheet feeding mechanism 22 is provided at a front side of the sheet feeding tray 21 and includes mainly a sheet feeding roller 23, a separation roller 24 and a separation pad 25.

In the sheet feeder unit 20 configured in the way described above, sheets P in the sheet feeding tray 21 are separated to be sent upwards sheet by sheet, and paper dust is removed therefrom while the sheet P is passing between a paper dust removing roller 26 and a pinch roller 27. Thereafter, the sheet P passes through a conveying path 28 to thereby be turned to a reverse direction so as to be fed to the image forming unit 30.

The image forming unit 30 includes mainly four LED units 40, four process cartridges 50, a transfer unit 70, a belt cleaner 10 and a fixing unit 80.

The LED units 40 are connected to the LED mounting members 5 so as to swing thereon and are supported while being positioned as required by a positioning member provided in the apparatus main body 2.

The process cartridges 50 are disposed to be aligned in a front-rear direction between the upper cover 3 and the feeder unit 20 and each include a photosensitive drum 51 as an example of a photosensitive member on which an electrostatic latent image is formed, a charger 52, a developing roller 53, a toner accommodation compartment 54 for accommodating toner as an example of developer, a cleaning roller 55 and the like.

The process cartridges 50 are denoted by 50K, 50Y, 50M and 50C as accommodating black toner, yellow toner, magenta toner and cyan toner, respectively, and are aligned sequentially in this order from an upstream side of the conveying direction of sheet P (the moving direction of a recording medium). In the specification and the drawings, when specifying the photosensitive drums 51, the developing rollers 53 and cleaning rollers 55 in accordance with the toner colors, reference characters K, Y, M, C are added thereto so as to make them correspond to black, yellow, magenta and cyan, respectively.

The photosensitive drums 51 are provided in the plurality of process cartridges 50 one in each process cartridge, and by the plurality of process cartridges 50 being disposed in the way described above, the photosensitive drums 51 are arranged in a row extending along the front-rear direction.

The developing roller 53 is brought into contact with the corresponding photosensitive drum 51 so as to supply toner to an electrostatic latent image formed on the photosensitive drum 51. In this embodiment, when toner is supplied from the developing roller 53 to the photosensitive drum 51, toner is charged to a positive polarity as an example of a first polarity by being held between the developing roller 53 and a supply roller, whose reference numeral is omitted, which are in sliding contact with each other.

Figure 2:
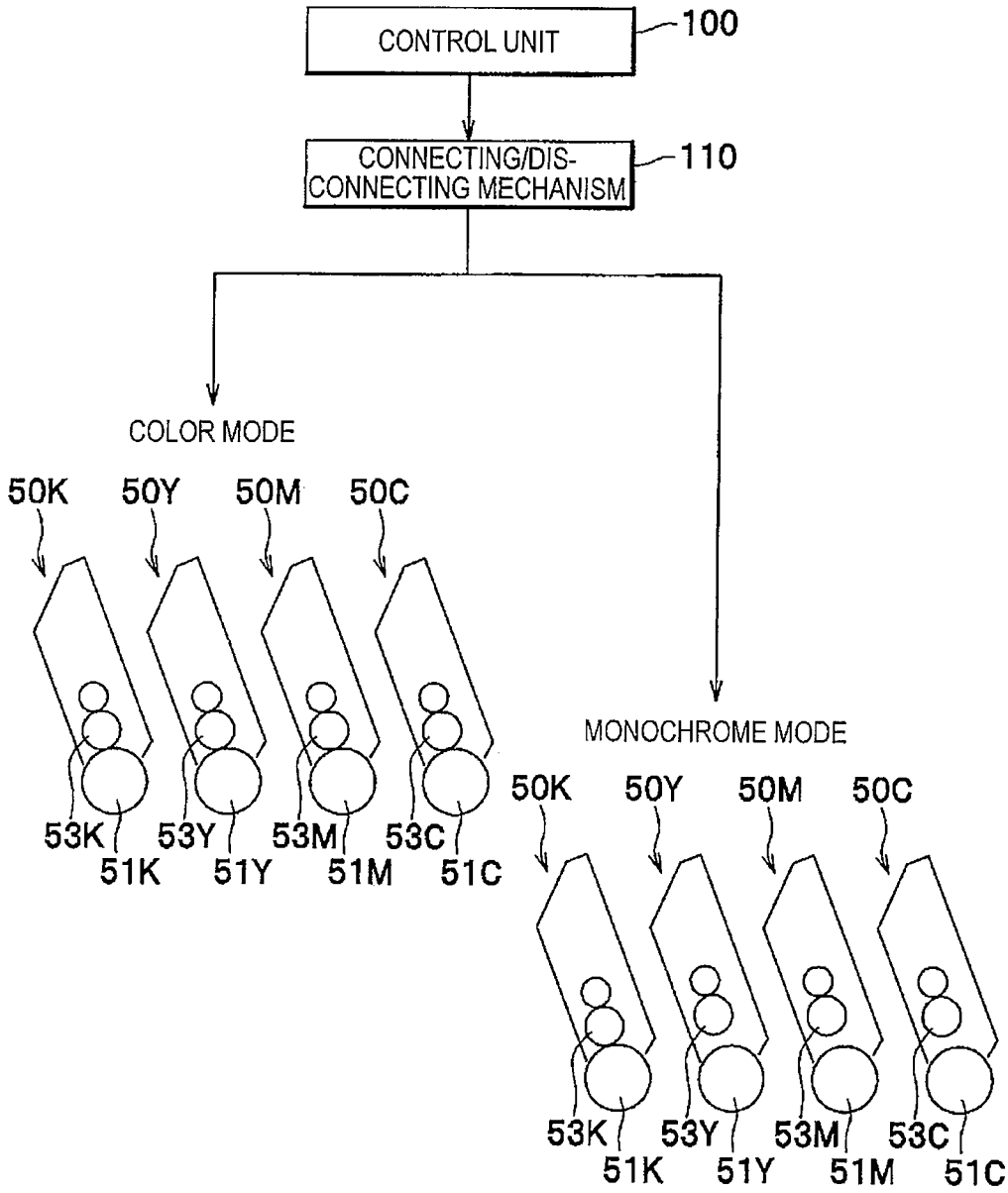
FIG. 2 is a drawing explaining the separation of photosensitive drums from developing rollers.

Then, as is shown in FIG. 2, the developing roller 53 is allowed to move towards or away from the corresponding photosensitive drum 51 by controlling a known separating mechanism 110 (similar to a switching mechanism described in Patent Document 1) by the control unit 100. To describe this in detail, as is shown in FIG. 1, a developing unit 530 which supports the developing roller 53 is supported movably on a drum unit 510 which supports the photosensitive drum 51. By controlling the movement of the developing unit 530 by the separating mechanism 110, the developing roller 53 is allowed to move towards or away from the corresponding photosensitive drum 51.

A plurality of cleaning rollers 55 are provided so as to correspond to the photosensitive drums 51 while being disposed adjacent to the corresponding photosensitive drum 51. A cleaning bias, which will be described later, is applied to the cleaning roller 55, whereby toner adhering to the photosensitive drum 51 can be held (recovered) by the cleaning roller 55.

The transfer unit 70 is provided between the feeder unit 20 and the process cartridges 50 and includes mainly a driving roller 71, a driven roller 72, a conveying belt 73 and transfer rollers 74.

The driving roller 71 and the driven roller 72 are disposed in parallel while being spaced away from each other in the front-rear direction, and the conveying belt 73, which is made up of an endless belt, is provided to extend therebetween. The conveying belt 73 has as an external surface thereof a belt surface 73A which faces and makes contact with the photosensitive drums 51. This belt surface 73A is caused to rotate by the driving roller 71 so that the belt surface 73A moves along the direction in which the photosensitive drums 51 are arranged. In addition, four transfer rollers 74 are provided inside the conveying belt 73 so as to be disposed to face the corresponding photosensitive drums 51 to thereby hold the conveying belt 73 together with those photosensitive drums 51. A transfer bias is applied to the transfer rollers 74 by a constant-current control at the time of transfer.

The belt cleaner 10 is a device adapted to be brought into sliding contact with the conveying belt 73 so as to recover toner which adheres to the conveying belt 73. The belt cleaner 10 is disposed underneath the conveying belt 73. Specifically, the belt cleaner 10 includes a sliding contact roller 11, a recovery roller 12, a blade 13 and a waste toner accommodation container 14.

The sliding contact roller 11 is disposed so as to be brought into contact with an outer circumferential surface of the conveying belt 73 and recovers matters adhering to the conveying belt 73 be a recovery bias being applied between a back-up roller 15 disposed on an inner circumferential surface of the conveying belt 73 and itself.

The recovery roller 12 is a roller which is brought into sliding contact with the sliding contact roller 11 and recovers the matters adhering to the sliding contact roller 11. Then, the matters adhering to the recovery roller 12 are scraped off by the blade 13 which is disposed so as to be brought into sliding contact with the recovery roller 12 and enter an interior of the waste toner accommodation container 14.

The fixing unit 80 is disposed at the rear of the process cartridges 50 and the transfer unit 70 and includes a heating roller 81 and a pressing roller 82 which is disposed so as to face the heating roller 81 to thereby press the same roller 81.

In the image forming unit 30 configured in the way described above, in the case of a color mode, firstly the surfaces of the photosensitive drums 51 are uniformly charged by the corresponding chargers 52 and thereafter are exposed by the corresponding LED units 40. By this exposure, the electric potentials of portions of the photosensitive drums 51 which are so exposed are decreased, whereby electrostatic latent images based on image data are formed on the photosensitive drums 51. Thereafter, toner images are carried on the photosensitive drums 51 by positively charged toner being supplied to the electrostatic latent images from the developing rollers 53.

By a sheet P that is fed onto the conveying belt 73 passing between the photosensitive drums 51 and the corresponding transfer rollers 74 which are disposed inside the conveying belt 73, the toner images formed on the photosensitive drums 51 are transferred onto the sheet P. Then, by the sheet P passing between the heating roller 81 and the pressing roller 82, the toner images transferred onto the sheet P are thermally fixed.

The sheet discharge part 90 includes mainly a discharge-side conveying path 91 which extends upwards from an exit of the fixing unit 80 to be turned to the front and a plurality of pairs of conveying rollers 92 for conveying a sheet P. The sheet P on which the toner images are thermally fixed is conveyed along the discharge-side conveying path 91 by the pairs of conveying rollers 92 to be discharged out of the apparatus main body 2 for accumulation in the sheet discharging tray 4.

<Control Unit>

Hereinafter, the control unit 100 will be described in detail.

The control unit 100 has a CPU, ROM, RAM and the like and is made to control the reception of a printing command (printing data), the feeder unit 20, the image forming unit 30, the sheet discharge part 90 and the separating mechanism 110 in accordance with a prepared program. In addition, a humidity sensor 200 is provided on the apparatus main body 2, and a signal detected by this humidity sensor 200 is inputted into the control unit 100.

The control unit 100 can execute a color mode (a mode in which a full color printing is executed by all the developing rollers 53) and a monochrome mode (a mode in which a single color printing is executed by the single color printing developing roller 53K) based on printing commands received from a switch on a control panel provided on the apparatus main body 2 or a personal computer connected to the apparatus main body 2.

Then, as shown in FIG. 2, at the time of executing the color mode, the control unit 100 controls the separating mechanism 110 so that all the developing rollers 53K, 53Y, 53M, 53C are brought into contact with their corresponding photosensitive drums 51K, 51Y, 51M, 51C. In contrast, at the time of executing the monochrome mode, the control unit 100 controls the separating mechanism 110 so that only the black developing roller 53K is brought into its corresponding photosensitive drum 51K, while the developing rollers 53Y, 53M, 53C for the other three colors (the developing rollers 53 for printing with the other colors) which are disposed downstream of the black developing roller 53K are separated from their corresponding photosensitive drums 51Y, 51M, 51C.

Further, at the time of executing the color mode, the control unit 100 executes a control in which a cleaning bias of a negative polarity (a second polarity) which constitutes a first electric potential V1 is applied to all the cleaning rollers 55. At the time of executing the monochrome mode, the control unit 100 executes a bias reduction control in which a cleaning bias applied to at least the cleaning rollers 55Y, 55M, 55C which correspond to the developing rollers 53Y, 53M, 53C which are separated from the corresponding photosensitive drums 51Y, 51M, 51C is made a second electric potential V2 which has a negative polarity and whose absolute value is smaller than that of the first electric potential V1. In the bias reduction control according to this embodiment, it is understood that the cleaning bias applied to all the cleaning rollers 55 in the monochrome mode is the second electric potential V2.

Here, the "second electric potential V2" is set so that its absolute value is smaller than an electric potential of toner when the polarity of the toner becomes negative under a high-temperature, high-humidity environment. Since it is possible to obtain the value of an electric potential of toner when it is negatively charged from experiments or simulations, the second electric potential V2 may be determined based on a value obtained by experiments or the like.

Figure 3A:
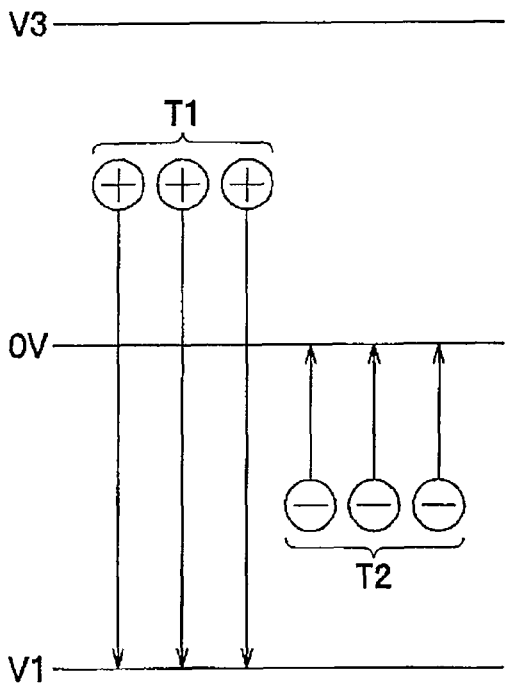
FIG. 3 is a drawing showing a relationship between a first electric potential, a second electric potential and a toner potential.
Figure 3B:
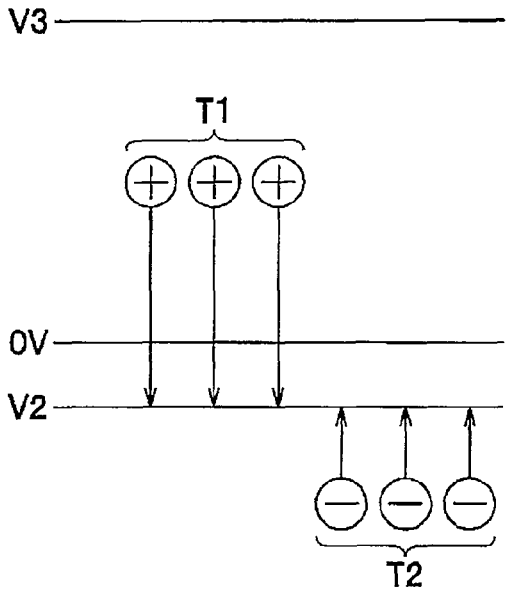

Specifically, the relationship between the first electric potential V1, the second electric potential V2 and a toner potential becomes a relationship shown in image diagrams in FIGS. 3A and 3B. Namely, as is shown in FIG. 3A, the first electric potential V1 used in the color mode takes a negative value whose absolute value is relatively large and is set to such an electric potential to attract well normal toner T1 which is positively charged. In contrast to this, as is shown in FIG. 3B, the second electric potential V2 used in the monochrome mode is set to an electric potential whose absolute value is smaller than an electric potential of negatively charged toner T2 which has an opposite property (an electric potential close to zero).

With the first and second electric potentials V1, V2 set as described above, when the electric potentials of the cleaning rollers 55 are kept at the first electric potential V1 even in the monochrome mode as conventionally, a situation is caused in which the negatively charged toner T2 whose property has become opposite cannot be attracted by the cleaning rollers 55 which are negative. In contrast to this, as in the embodiment, the cleaning bias applied to the cleaning rollers 55Y, 55M, 55C is made the second electric potential V2 which has the negative polarity and whose absolute value is smaller than that of the first electric potential V1 (to describe this in detail, the absolute value is smaller than that of the negatively charged toner T2 whose property becomes opposite), whereby the negatively charged toner T2 can be attracted for recovery by the cleaning rollers 55Y, 55M, 55C.

Further, at the time of executing the monochrome mode, the control unit 100 does not execute the bias reduction control in the event that the humidity detected by the humidity sensor 200 is equal to or smaller than a predetermined value.

After the monochrome mode ends, the control unit 100 controls the separating mechanism 110 so as to bring the developing rollers 53Y, 53M, 53C which have been separated from the corresponding photosensitive drums 51Y, 51M, 51C into contact with the corresponding photosensitive drums 51Y, 51M, 51C and changes the cleaning bias from the second electric potential V2 to the first electric potential V1 while the cleaning rollers 55 rotate one rotation since the re-contact of the developing rollers 53Y, 53M, 53C with their corresponding photosensitive drums 51Y, 51M, 51C.

Here, in this embodiment, although the cleaning bias is changed to the first electric potential V1, the invention is not limited thereto, and hence, any cleaning bias may be adopted, provided that its polarity is negative (the second polarity) and its absolute value is larger than that of the second electric potential V2 (to be in detail, its absolute value is larger than the absolute value of the negatively charged toner T2). In addition, it should be ensured that the time during which the cleaning bias is kept changed to the bias whose absolute value is larger than that of the second electric potential V2 is equal to at least the time during which the cleaning rollers 55 rotate only one rotation and the cleaning bias may be kept so changed longer than that.

Specifically, the control unit 100 executes the controls described above by following a flowchart shown in FIG. 4.

Figure 4:
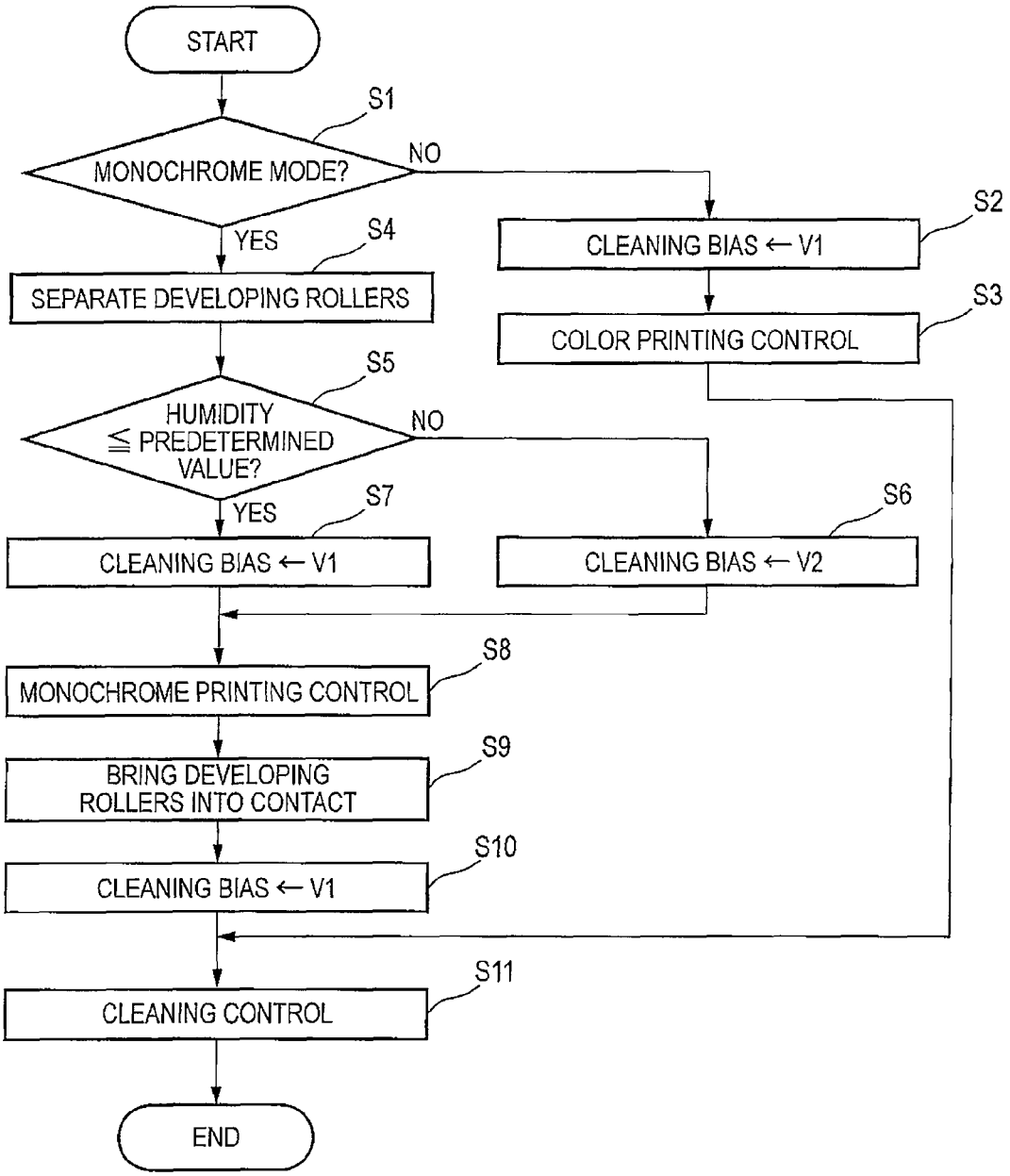
FIG. 4 is a flowchart showing the operation of a control unit.

As is shown in FIG. 4, if receiving a printing command (START), the control unit 100 determines based on the printing command whether to execute the monochrome mode (S1). In step S1, if the control unit 100 determines not to execute the monochrome mode, that is, if the control unit 100 determines to execute the color mode (No), the control unit 100 applies the cleaning bias of the first electric potential V1 to all the cleaning rollers 55 (S2) and executes a known color printing control (S3).

If the control unit 100 determines to execute the monochrome mode in Step S1 (Yes), the control unit 100 controls the separating mechanism 110 so as to separate the developing rollers 53Y, 53M, 53C which correspond to the other three colors than black from the corresponding photosensitive drums 51Y, 51M, 51C (S4). After step S4, the control unit 100 determines whether or not the humidity is equal to or smaller than a predetermined based on a signal from the humidity sensor 200 (S5).

If the control unit 100 determines in step S5 that the humidity exceeds the predetermined value (No), the control unit 100 applies the cleaning bias of the second electric potential V2 to all the cleaning rollers 55, that is, the control unit 100 executes the bias reduction control (S6). In addition, if the control unit 100 determines in step S5 that the humidity is equal to or smaller than the predetermined value (Yes), the control unit 100 does not execute the bias reduction control (S6) but applies the cleaning bias of the first electric potential V1 to all the cleaning rollers 55 (S7).

After step S6 or step S7, the control unit 100 executes a known monochrome printing control (S8). After step S8, the control unit 100 controls the separating mechanism 110 so as to bring the developing rollers 53Y, 53M, 53C into contact with the corresponding photosensitive drums 51, 51M, 51C (S9).

After step S9, the control unit 100 changes or holds the cleaning bias to or at the first electric potential V1 for a predetermined length of time (the time during which the cleaning rollers 55 rotate one rotation) (S10). After step 10 or step S3, the control unit 100 executes a known cleaning control in which toner recovered by the cleaning rollers 55 is recovered by the belt cleaner 10 via the conveying belt 73 (S11) and ends this control.

Next, referring to FIGS. 5A to 6, a function will be described which is to be implemented when toner is reversely transferred. Firstly, a situation will be described in which toner that is reversely transferred is positively charged.

Note that in the following description, a situation in which black toner TK is reversely transferred to the yellow photosensitive drum 51Y will be described to represent the other reverse transfers. Since the same function takes place on the photosensitive drums 51M, 51C for the other colors, the description thereof will be omitted here.

Figure 5A:
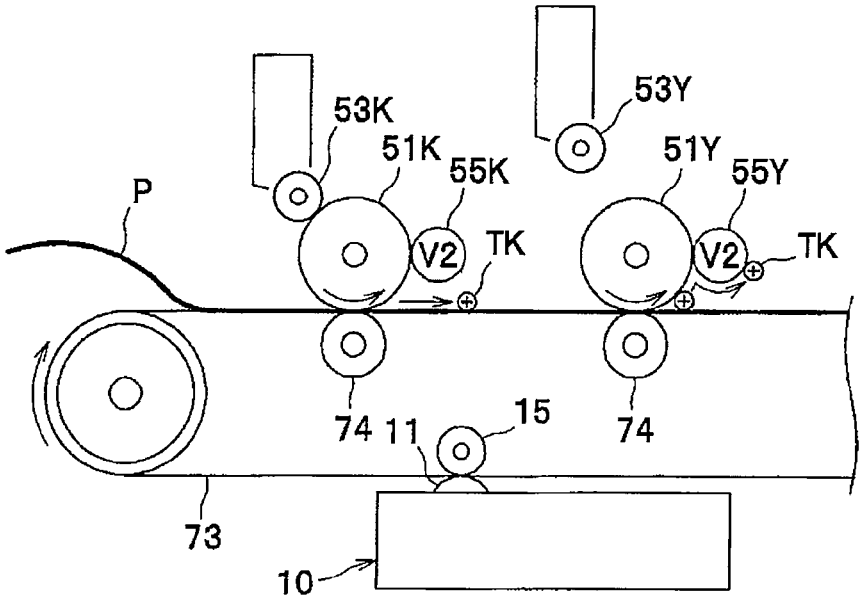
FIG. 5A is a drawing showing a movement of positively charged toner when it is reversely transferred.
Figure 5B:
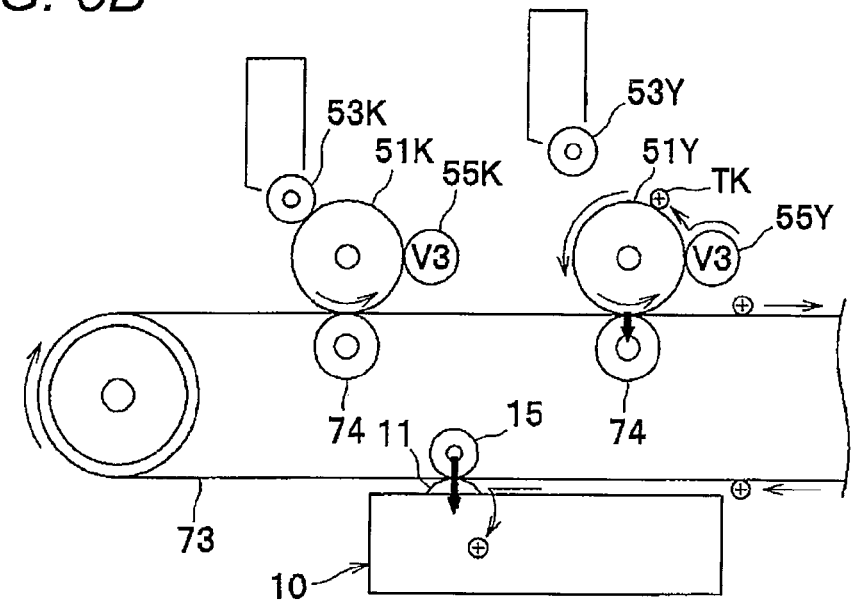
FIG. 5B is a drawing showing a movement of the toner when a cleaning control is executed.

As is shown in FIG. 5A, when black toner TK is reversely transferred from the black photosensitive drum 51K to the yellow photosensitive drum 51Y via a sheet P in the monochrome mode, this toner TK is recovered by the yellow cleaning roller 55Y to which the second electric potential V2 which is negative and whose absolute value is smaller than that of the first electric potential V1. Note that since the cleaning bias becomes the first electric potential V1 which is negative and whose absolute value is larger than that of the second electric potential V2 in the color mode, the toner TK which is positively charged is recovered by the cleaning roller Y in a more ensured fashion.

Then, when the printing control ends after the toner TK has been recovered by the cleaning roller Y in the way described above, as is shown in FIG. 5B, the known cleaning control is executed. To describe this in detail, at the time of executing the cleaning control, a third electric potential V3 (refer to FIGS. 3A and 3B) which is positive and whose absolute value is relatively large is applied to the cleaning roller 55Y, whereby the toner TK is transferred from the cleaning roller 55Y to the corresponding photosensitive drum 51Y.

The toner TK transferred to the photosensitive drum 51Y is then transferred to the conveying belt 73 by a transfer bias and is conveyed to the belt cleaner 10 by the rotating conveying belt 73 so as to be recovered by the belt cleaner 10 by a recovery bias.

Next, a situation in which toner reversely transferred is negatively charged will be described.

Figure 6A:
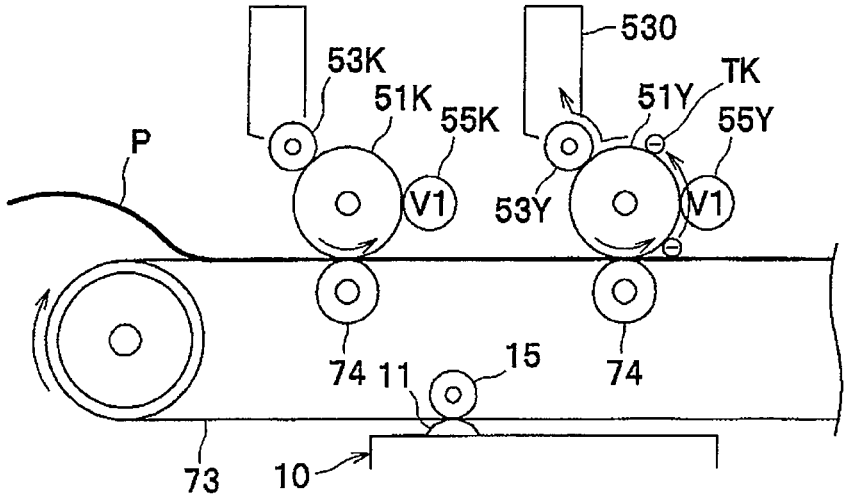
FIG. 6A is a drawing of negatively charged toner when it is reversely transferred in a color mode.

As is shown in FIG. 6A, in the color mode, when black toner TK is reversely transferred to the yellow photosensitive drum 51Y, the toner TK is not transferred to the cleaning roller 55Y to which the first electric potential V1 which is negative and whose absolute value is larger than that of the toner TK but passes a nip position between the cleaning roller 55Y and the photosensitive drum 51Y. However, in the color mode, since the developing roller 53Y is in contact with the corresponding photosensitive drum 51Y, the negatively charged toner TK is recovered well by the developing roller 53Y which holds positively charted toner and is then dispersed into the developing unit 530.

Figure 6B:
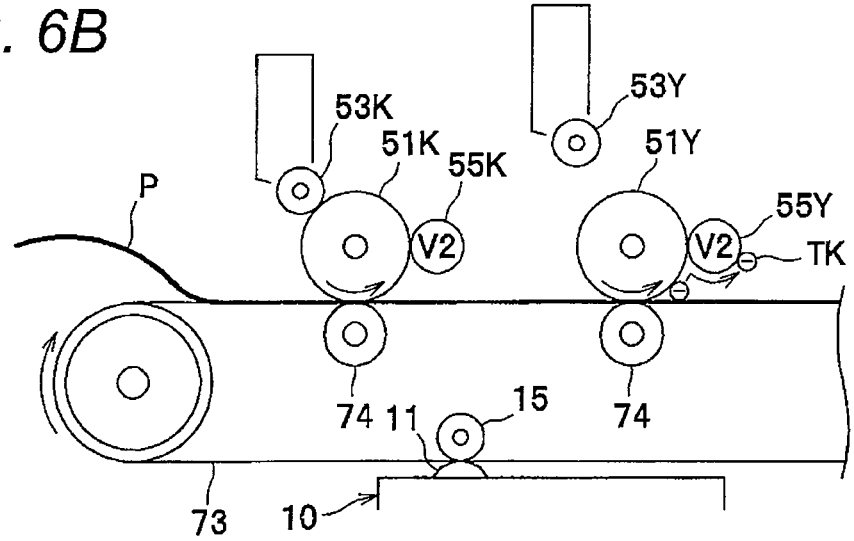
FIG. 6B is a drawing showing a movement of the negatively charged toner when it is reversely transferred in a monochrome mode.
Figure 6C:
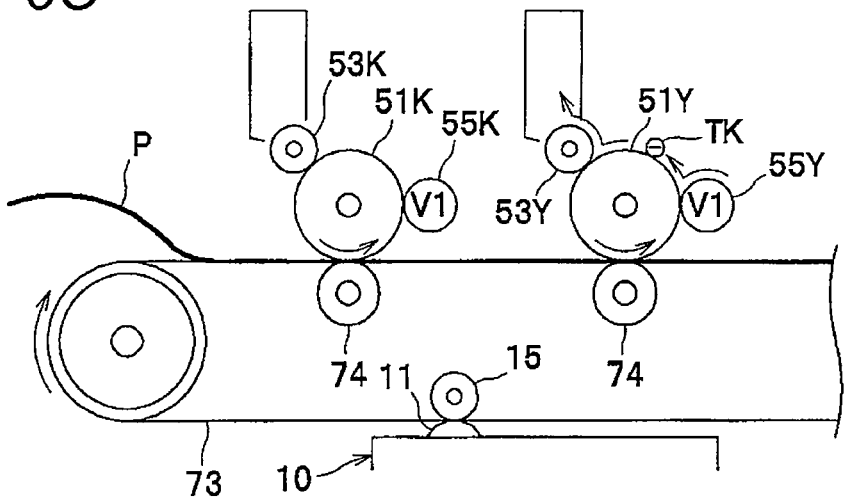
FIG. 6C is a drawing showing a movement of the toner when the toner recovered by a cleaning roller is recovered by a developing roller.

In contrast to this, in the monochrome mode, as is shown in FIG. 6B, since the developing roller 53Y is separated from the photosensitive drum 51Y, in case the cleaning roller 55Y is kept holding the first electric potential V1 as in the color mode, the toner TK passes the nip position to thereby be transferred to a sheet P to generate a ghost image thereon.

However, as in this embodiment, when the cleaning bias that is applied to the cleaning roller 55Y is the second electric potential, the negatively charged toner TK can be recovered by the cleaning roller 55Y to thereby be held thereon.

When the printing control ends after the toner TK has been recovered by the cleaning roller 55Y in the way described above, as is shown in FIG. 6C, the developing roller 53Y is brought into contact with the photosensitive drum 51Y, and the cleaning bias is changed to the first electric potential V1 (steps S9, S10 in FIG. 4), whereby the toner TK which has been held on the cleaning roller 55Y is transferred to the photosensitive drum 51Y to thereafter be recovered by the developing roller 53Y.

Thus, the following advantages can be obtained in this embodiment.

Even when the toner TK whose polarity is changed to the negative polarity is reversely transferred to the photosensitive drum 51Y from which the corresponding developing roller 53Y is separated, the negatively charged toner TK can be recovered by the cleaning roller 55 to which the cleaning bias of the second electric potential V2 is applied. Because of this, the generation of a ghost image by the toner TK which is reversely transferred can be restrained.

The developing roller 53 is brought into contact with the photosensitive drum 51 after the monochrome printing and the cleaning bias is changed from the second electric potential V2 to the first electric potential V1 while the cleaning roller 55 rotates one rotation. Therefore, the negatively charged toner TK held on the cleaning roller 55 can be recovered into the developing unit 530 via the photosensitive drum 51.

In the monochrome mode, in the event that the humidity is smaller than the predetermined value, the bias reduction control is not executed. Therefore, toner which continues to be positively charged can be recovered by the cleaning roller 55 whose absolute value is high and to which the cleaning bias (of the first electric potential V1) is applied in an ensured fashion.

Note that the invention is not limited to the embodiment described heretofore but can be used in various forms which will be illustrated below.

In the embodiment, while the negatively charged toner TK is recovered by the developing roller 53 which is brought into contact with the photosensitive drum 51 after the end of the monochrome printing control, the invention is not limited thereto, and hence, the negatively charged toner TK may be recovered by the belt cleaner 10.

Figure 7:
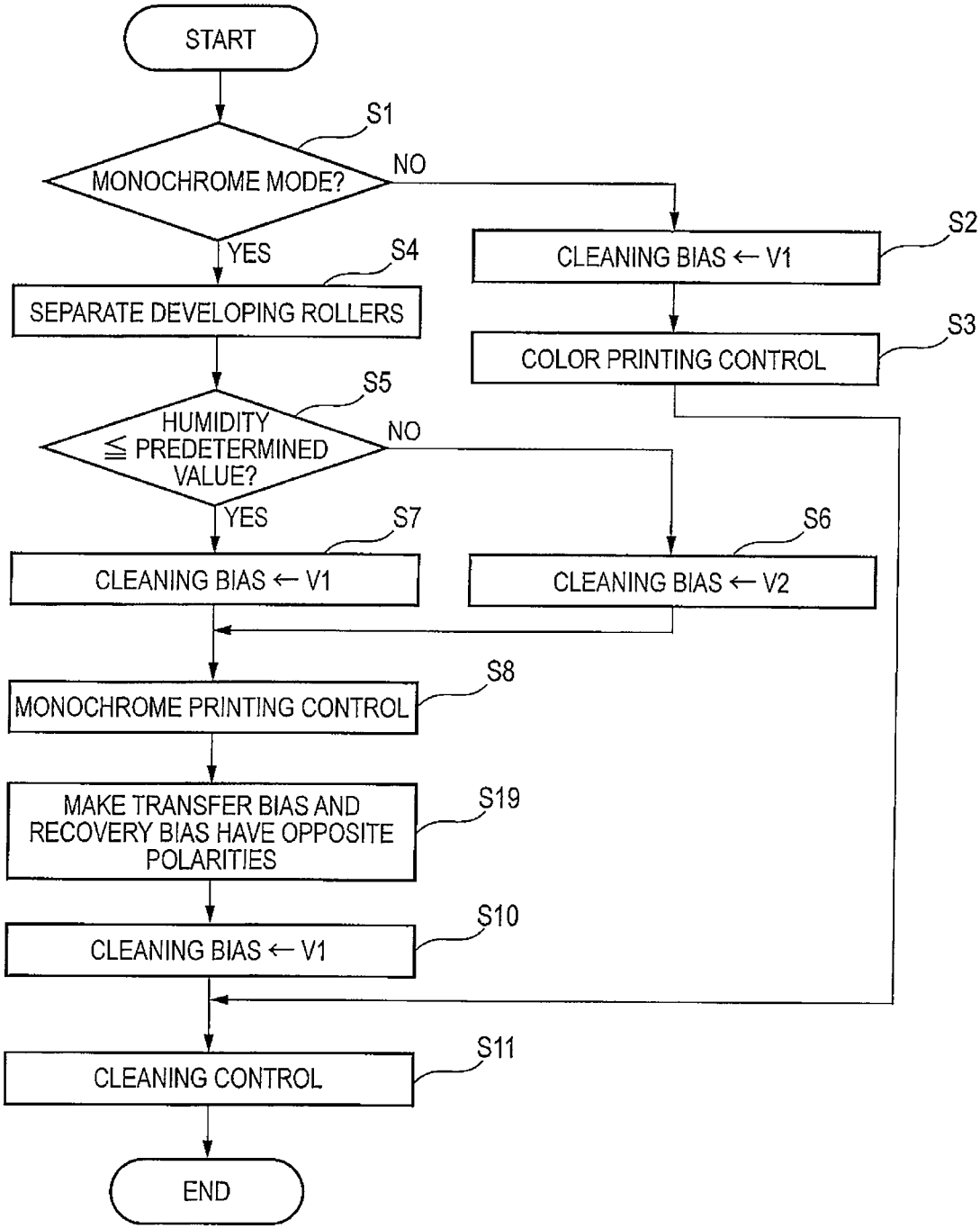
FIG. 7 is a flowchart showing a modified example of an operation of the control unit.

Namely, the control unit may be configured so as to execute a control following a flowchart shown in FIG. 7, for example. Specifically, in this control, in place of step S9 in the flowchart shown in FIG. 4, there is provided step S19 in which the transfer bias applied between the photosensitive drum 51 and the transfer roller 74 and the recovery bias applied between the sliding contact roller 11 and the back-up roller 15 are made to have an opposite property to that they have in the printing control.

Namely, in steps S19, S10, a control (a cleaning control for negatively charged toner in which a bias that is applied to each roller is changed only) is executed which is substantially similar to the cleaning control for positively charged toner (S11).

Figure 8A:
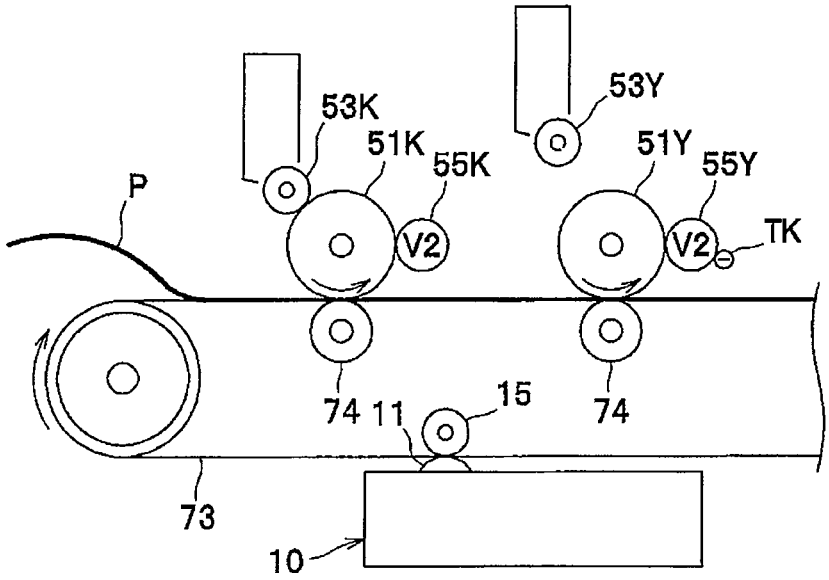
FIGS. 8A and 8B show drawings explaining the movement of toner under the control shown in FIG. 7.
Figure 8B:
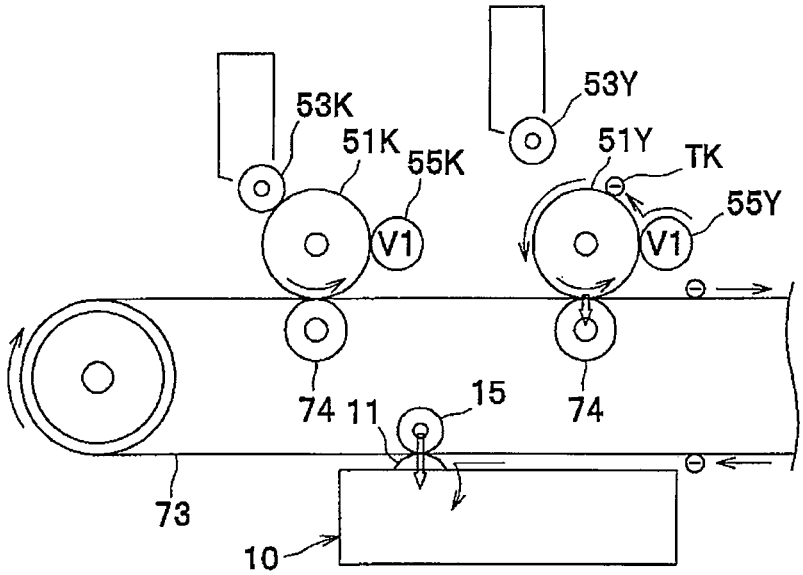

According to this control, as is shown in FIG. 8A, when negatively charged toner TK is recovered by the cleaning roller 55Y after printing has ended, by executing the operations in steps S19, S10, as is shown in FIG. 8B, the negatively charged toner TK on the cleaning roller 55Y can be recovered by the belt cleaner 10 via the photosensitive drum 51Y and the conveying belt 73.

In the embodiment, while the humidity condition is taken into consideration, the invention is not limited thereto. In the case of executing the monochrome mode without taking the humidity condition into consideration, the cleaning bias may continue to be the second electrical potential V2.

In the embodiment, while the cleaning bias which is the second electric potential V2 is applied to all the cleaning rollers 55 in step S6, the invention is not limited thereto. For example, in the monochrome mode, a configuration may be adopted in which the cleaning bias of the first electric potential V1 is applied to the black cleaning roller (that is, the cleaning roller which corresponds to the photosensitive drum with which the developing roller is in contact) while the cleaning bias of the second electric potential V2 is applied to the cleaning rollers for the other colors.

According to this configuration, when positively charged toner which has not been transferred to the sheet remains on the black photosensitive drum, the positively charged toner can be recovered in an ensured fashion by the cleaning roller to which the cleaning bias of the first electric potential V1 is applied which is negative and whose absolute value is large. Note that the cleaning bias applied to the black cleaning roller in the monochrome mode is not limited to the first electric potential described above, and hence, any bias may be applied thereto, provided that the bias is negative and its absolute value is larger than that of the second electric potential.

In the embodiment, while black is adopted as the color used in the single color printing, the invention is not limited thereto, and hence, the other colors than black may be adopted.

In the embodiment, while in the plurality of developing rollers, the developing roller for use in the single color printing is disposed at an upstreammost end of the traveling direction of the belt surface, the invention is not limited thereto, and hence, the single color printing developing roller may be disposed in any positions except for a downstreammost position.

In the embodiment, while the first polarity is referred to as positive, while the second polarity as negative, the invention is not limited thereto, and hence, the first and second polarities may be referred to as the other way round.

In the embodiment, while the invention is applied to the color printer 1, the invention is not limited thereto, and hence, the invention may be applied to other image forming apparatuses such as a photocopier or a multifunction device, for example.

In the embodiment, while the photosensitive drum 51 is adopted as the photosensitive member, the invention is not limited thereto, and hence, for example, a belt-shaped photosensitive member may be adopted.

In the embodiment, while the conveying belt 73 for conveying a sheet P is adopted as the belt, the invention is not limited thereto, and hence, for example, an intermediate transfer belt may be adopted to which a toner image is transferred.

In the embodiment, while sheets P such as sheets of thick paper, post cards and sheets of thin paper are adopted as an example of a recording sheet, the invention is not limited thereto, and hence, OHP sheets may also be adopted.

What is claimed is:

1. An image forming apparatus comprising:

first and second photosensitive members which are arranged in a row, and are configured to form an electrostatic latent image thereon;

an endless belt having a belt surface which faces the first and second photosensitive members and configured to rotate so that the belt surface moves in a traveling direction from the first photosensitive member to the second photosensitive member;

first and second developing rollers configured to respectively supply, to the first and second photosensitive members, developer of different colors which is charged to a first polarity;

first and second cleaning rollers provided so as to be adjacent respectively to the first and second photosensitive members for recovering developer adhering to the first and second photosensitive members;

a separating mechanism configured to separate the second developing roller from the second photosensitive member; and a control unit configured to, if a single color printing is executed by the first developing roller, control the separating mechanism so as to separate the second developing roller from the second photosensitive member, wherein if a multi-color printing is executed, the control unit applies a cleaning bias whose polarity is a second polarity opposite to the first polarity and which holds a first electric potential to each of the first and second cleaning rollers, and wherein, if the single color printing is executed, the control unit executes a bias reduction control in which a cleaning bias applied to the second cleaning roller is given the second polarity and is made to hold a second electric potential whose absolute value is smaller than that of the first electric potential.

2. The image forming apparatus according to claim 1, further comprising a belt cleaner configured to recover developer adhering to the belt, wherein the control unit changes the cleaning bias, which is made to hold the second electric potential by the bias reduction control, to a cleaning bias whose polarity is the second polarity and whose absolute value is larger than that of the second electric potential for at least a length of time equal to a time during which the second cleaning roller rotates one rotation after the single color printing ends.

3. The image forming apparatus according to claim 1, wherein the control unit:

controls the separating mechanism so as to bring the second developing roller, which is separated from the second photosensitive member, into contact with the second photosensitive member; and changes the cleaning bias which is made to hold the second electric potential by the bias reduction control to a cleaning bias whose polarity is the second polarity and whose absolute value is larger than that of the second electric potential for at least a length of time equal to a time during which the second cleaning roller rotates one rotation after the single color printing ends.

4. The image forming apparatus according to claim 1, further comprising a humidity sensor configured to detect humidity, wherein, in executing the single color printing, the control unit does not execute the bias reduction control if humidity detected by the humidity sensor is equal to or larger than a value.

5. The image forming apparatus according to claim 1, wherein, in executing the single color printing, the control unit applies a cleaning bias whose polarity is the second polarity and whose absolute value is larger than that of the second electric potential to the first cleaning roller.

* * * * *